US006298678B1

(12) United States Patent
Kim

(10) Patent No.: US 6,298,678 B1
(45) Date of Patent: Oct. 9, 2001

(54) WINDOW-TYPE AIR CONDITIONER

(75) Inventor: Jung-Ho Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/543,158

(22) Filed: Apr. 4, 2000

(30) Foreign Application Priority Data

May 8, 1999 (KR) ..... 99/16486

(51) Int. Cl.[7] ..... F25D 23/12
(52) U.S. Cl. ..... 62/262; 62/285; 62/279
(58) Field of Search ..... 62/262, 285, 279

(56) References Cited

U.S. PATENT DOCUMENTS 4,651,959 * 3/1987 Bolton et al. ..... 248/208
4,773,232 * 9/1988 Lang et al. ..... 62/298
5,253,485 * 10/1993 Kennedy et al. ..... 62/262
5,437,164 * 8/1995 Consiglio ..... 62/259.1
6,067,812 * 5/2000 Bushnell et al. ..... 62/280

* cited by examiner

*Primary Examiner*—William Doerrler
*Assistant Examiner*—Mark S. Shulman
(74) *Attorney, Agent, or Firm*—Robert E. Bushnell, Esq.

(57) ABSTRACT

An improved window-type air conditioner for easy installation includes: a main unit having a base plate on which heavy components of the air conditioner, such as a compressor, and indoor and outdoor heat-exchangers, are mounted; a cabinet for receiving the main unit through an opening in the front side thereof; and an inclination section for maintaining a predetermined downward inclination of the main unit in the cabinet. The inclination section includes at least two guide rails formed on a bottom of the cabinet at a predetermined downward inclination toward the outside for supporting the lower side of the base plate.

17 Claims, 5 Drawing Sheets

WINDOW-TYPE AIR CONDITIONER

BACKGROUND OF THE INVENTION

1. Field of the Invention

The present invention relates to a window-type air conditioner cabinet, and more particularly to an improved apparatus for installing the window-type air conditioner cabinet. The invention also concerns a method for installing the cabinet by means of the forgoing apparatus.

2. Prior Art

FIG. 1 shows one example of a conventional window-type air conditioner including a main unit 15, a cabinet 12, and a front panel 14. The main unit 15 includes a base plate 16, on which a compressor 17, an outdoor heat-exchanger 18*b*, a capillary tube (not shown), and an indoor heat-exchanger 18*a* connected by a pipe in a closed circuit of refrigerant cycle are installed.

As the air conditioner is operated, and compressor 17 is driven, high-temperature and high-pressure gaseous refrigerant flows into the outdoor heat-exchanger 18*b*, at which the refrigerant is condensed through heat exchange with outside air which is blown by an outdoor fan 19*b*.

The condensed refrigerant flows into the indoor heat-exchanger 18*a* after being depressurized at the capillary tube, and is evaporated at the indoor heat-exchanger 18*a* while taking the heat from the indoor ambient air. The chilled air flows back into the room by an indoor fan 19*a*. Here, the vapor of the ambient air is condensed into water droplets on the surface of the indoor heat-exchanger 18*a*, and the water droplets gravitate along the bottom of the base plate 16 to the outside through a drain hole 20 (see FIG. 2).

The installation procedure of a conventional window-type air conditioner constructed as above is described with reference to FIGS. 2 and 3. The air conditioner includes a guide rail 13 formed on a bottom of cabinet 12 to guide main unit 15 for the smooth insertion of the main unit 15 into the cabinet 12. A rail groove 16*a* is formed on the lower side of base plate 16, to correspond to guide rail 13.

Drain hole 20 is formed on the external side of base plate 16. The condensate droplets generated during the heat exchange at indoor heat-exchanger 18*a* are dropped onto base plate 16, and drain to the outside through drain hole 20. For efficient drainage of the condensate droplets, the air conditioner is installed in a wall 1 or a window (not shown) of the room. The air conditioner is downwardly inclined by an installation bracket 3, so as to incline base plate 16 toward the outside at the downward inclination of 2°–5°.

The air conditioner's main unit 15 is loaded with heavy, metal components such as compressor 17, indoor heat-exchanger 18*a*, and outdoor heat-exchanger 18*b*. Accordingly, it is difficult to install the air conditioner at an exact angle of inclination in the wall 1 while lifting the body of the air conditioner. Accordingly, the air conditioner is installed in such a way that cabinet 12, which forms the outer appearance of the air conditioner, is first mounted in the wall 1, and then the main unit 15 loaded with the components is mounted into cabinet 12.

More particularly, front panel 14 and the main unit 15 are separated from cabinet 12. Then, cabinet 12 is mounted in an installation opening 2 of the wall 1 (or in the window). Here, the cabinet 12 is mounted at a downward inclination angle ($\alpha$) with respect to the outside, and the downward inclination angle preferably ranges approximately from 2° to 5°. Then, rail groove 16*a* of base plate 16 is aligned with the guide rail on the bottom of cabinet 12, and the main unit 15 is inserted into the cabinet 12. Next, using fastening means such as a bolt 11 (see FIG. 1), base plate 16 is fastened through holes 12*a* (see FIG. 1) formed on both sides of cabinet 12, and the main unit 15 is fixed into the cabinet 12. The air conditioner is completely installed when front panel 14 is mounted on the front side of the cabinet 12.

The above-described conventional air conditioner installation, however, involves several problems. First, to efficiently drain the condensate droplets formed at the indoor heat-exchanger 18*a*, the base plate 16 must be installed at a downward inclination angle ($\alpha$) with respect to the outside. Since the installation opening 2 or the window has horizontal upper and lower sides, it is difficult to install the cabinet 12 at the downward inclination angle with respect to the horizontal side of the cabinet 12, and the air conditioner is not stable when installed. Further, while installing the cabinet 12 at the downward inclination angle, the cabinet 12 and the upper and lower sides of the installation opening 2 interfere with each other, resulting in possible deformation or fracture thereof.

SUMMARY OF THE INVENTION

It is an object of the present invention to overcome the above-mentioned problems of the prior art. Accordingly, it is an object of the present invention to provide a window-type air conditioner in which the cabinet is maintained at a horizontal level while the base plate is at a downward inclination, in order to make the installation easier and to prevent deformation or fracture of the cabinet or the wall.

To this end, the present invention provides an air conditioner having: a main unit having a base plate on which components of the air conditioner, such as the compressor, and indoor and outdoor heat-exchangers, are mounted; a cabinet for receiving the main unit through an opening in the front side thereof; a front panel for covering the open front side of the cabinet; and an inclination section ("skid") for maintaining a predetermined downward inclination of the main unit in the cabinet. The inclination section includes at least two guide rails formed on the bottom of the cabinet at a predetermined downward inclination toward the outside for supporting the lower side of the base plate. The inclination angle preferably ranges from 2° to 5°.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components.

DETAILED DESCRIPTION OF PREFERRED EMBODIMENT

Figure 4:
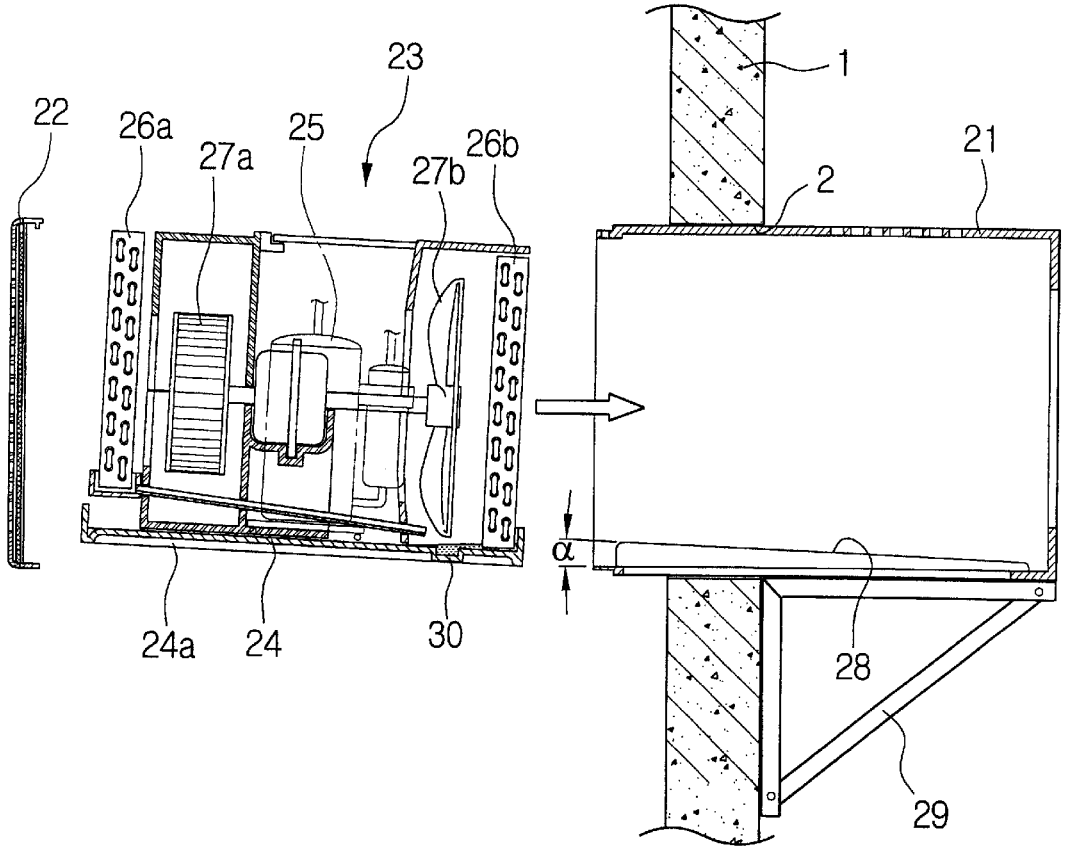
FIG. 4 is a sectional view showing the installation procedures of a window-type air conditioner according to a preferred embodiment of the present invention.
Figure 5:
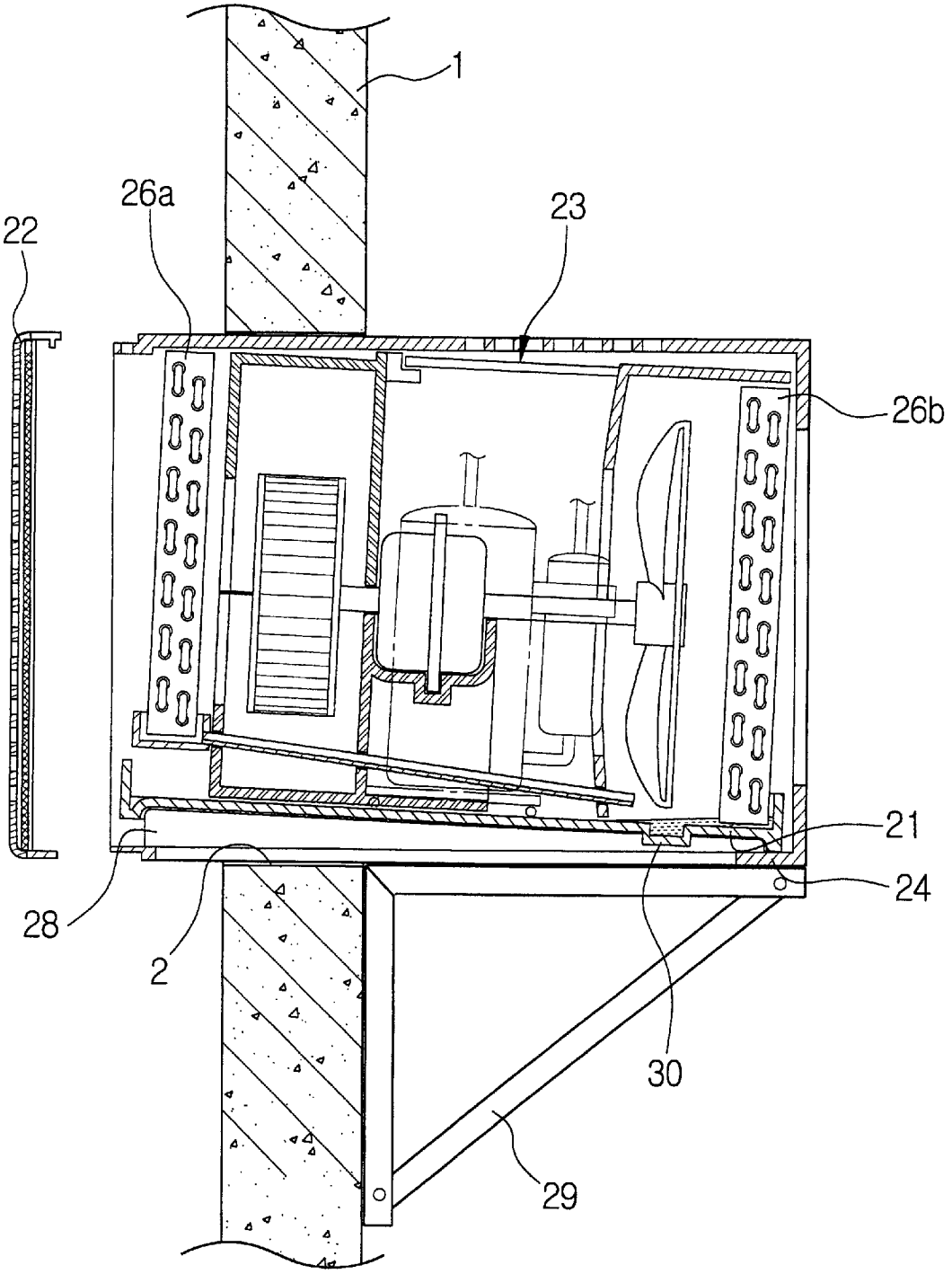
FIG. 5 is a sectional view showing the window-type air conditioner being installed according to a preferred embodiment of the present invention.

FIGS. 4 and 5 show the window-type air conditioner according to a preferred embodiment of the present invention. As shown, the window-type air conditioner according to this embodiment of the invention includes a cabinet 21, a front panel 22, a main unit 23, and an inclination section 28.

Main unit 23 includes base plate 24 on which a compressor 25, indoor and outdoor heat-exchangers 26*a* and 26*b*, respectively, and indoor and outdoor fans 27*a* and 27*b*, respectively, are installed. Base plate 24 includes a drain hole 30 formed on the external side of the base plate 24 for draining out the condensate droplets generated at indoor heat-exchanger 26*a*. A rail groove 24*a* is formed on the lower side thereof, in the lengthwise direction from the inner to the outer side thereof, for guiding a guide rail of inclination section 28.

Cabinet 21 forms the outer appearance of the window-type air conditioner, and receives main unit 23 therein. The front side of cabinet 21 is open, while inclination section 28 (preferably a pair of guide rails) is formed on the bottom of the cabinet 21. The inclination section 28 is preferably two guide rails 28*a* formed on the bottom of the cabinet 21 for guiding the insertion of the main unit 23. Guide rails 28*a* are installed at a predetermined downward inclination angle ($\alpha$) with respect to the horizontal plane toward the outside. The angle of inclination of guide rails 28 preferably ranges approximately from 2° to 5°, and more preferably at 3°. Equivalently, the guide rails 28*a* can be attached to the bottom of the main unit 23 so long as the net effect is to maintain the predetermined inclination angle.

Figure 1:
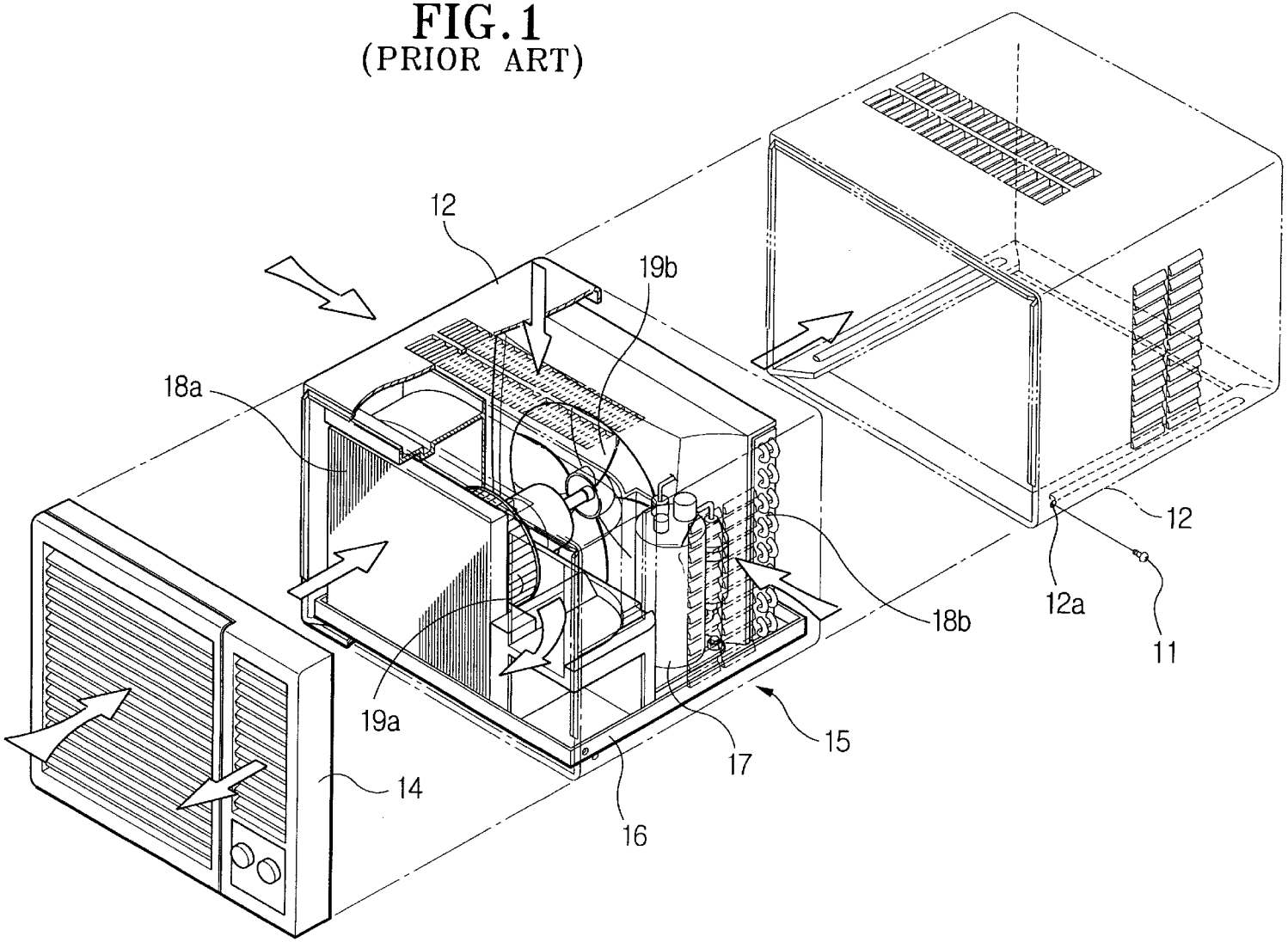
FIG. 1 (PRIOR ART)
FIG. 1 is an exploded perspective view showing the structure of a conventional window-type air conditioner.
Figure 2:
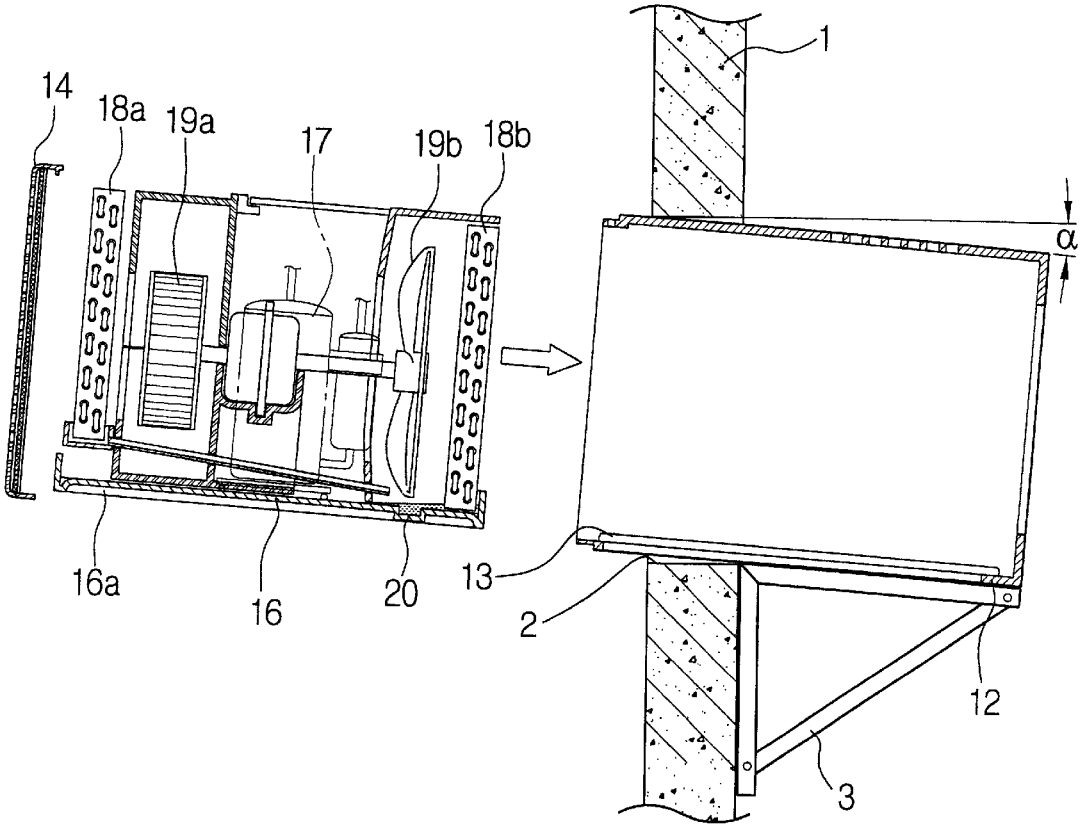
FIG.2 (PRIOR ART)
FIG. 2 is a sectional view showing the installation of the conventional window-type air conditioner.
Figure 3:
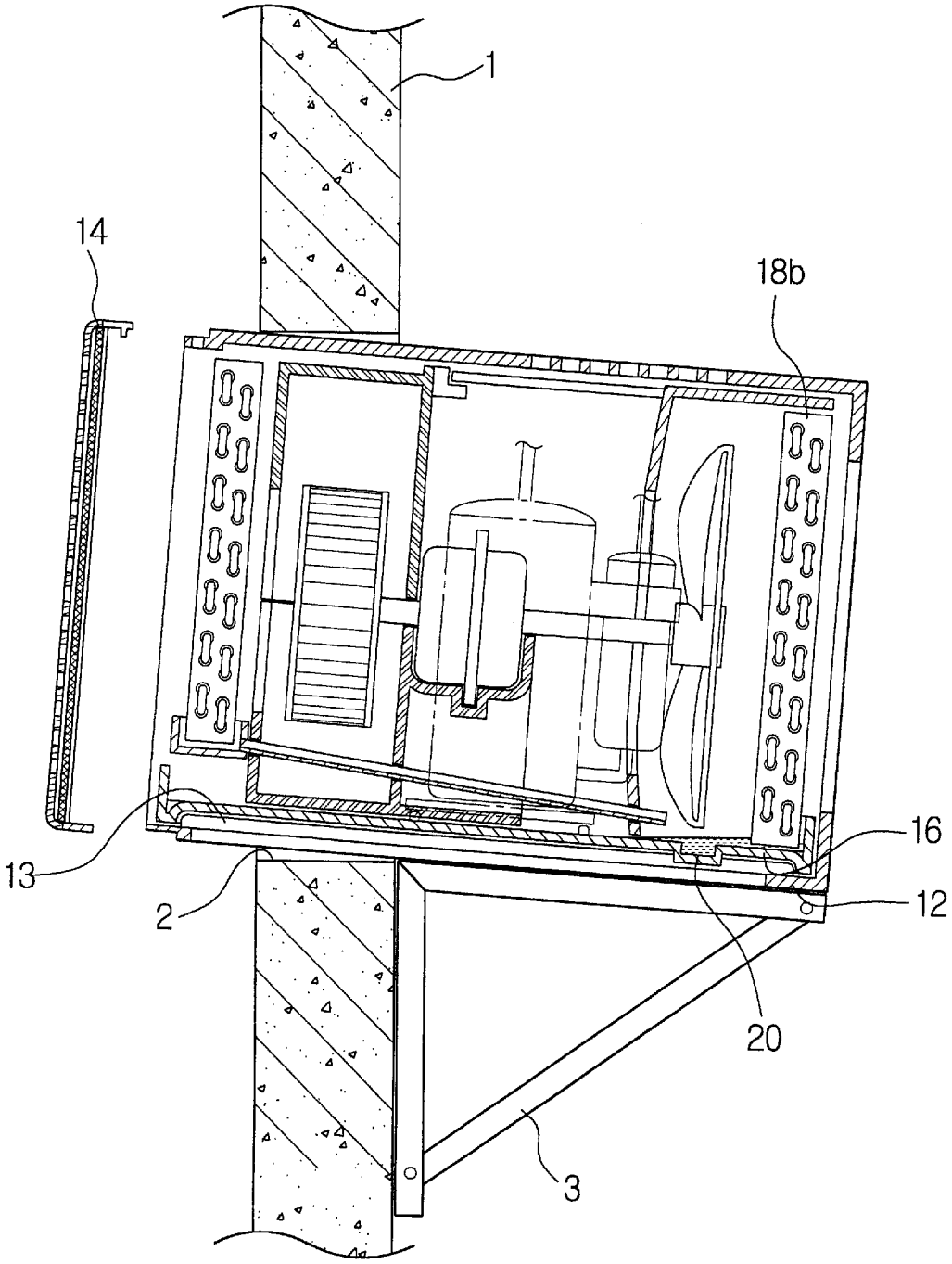
FIG.3 (PRIOR ART)
FIG. 3 is a sectional view showing the conventional window-type air conditioner being installed.

Further, albeit not shown in the drawings, coupling holes are formed on both internal sides of base plate 24 of main unit 23 and cabinet 21, respectively, to receive fastening means such as bolts 11 (see FIG. 1).

The installation procedure of the window-type air conditioner according to the preferred embodiment of the present invention is as follows. As shown in FIG. 4, front panel 22 and main unit 23 are separated from cabinet 21. The cabinet is mounted on an installation opening 2 (or window) of a wall 1 of a room. Here, unlike the conventional procedure, cabinet 21 is mounted in parallel relation with respect to the horizontal plane. Accordingly, it is easy to install and position cabinet 21, while the possibility of interference between the upper and lower sides of cabinet 21 with the upper and lower sides of the installation opening 2 (or the window) is reduced. Accordingly, the cabinet and the installation opening 2 (or the window) are prevented from experiencing possible deformation or fracture.

When cabinet 21 is completely installed, then main unit 23 is lifted so as to be inserted into cabinet 21 through the open front side thereof. In such a situation, rail groove 24*a* of base plate 24 is aligned with guide rail 28*a* of the cabinet 21, and is inserted therealong. Here, as shown in FIG. 5, since the guide rail 28*a* is at a downward inclination ($\alpha$) with respect to the outside of the building, the main unit 23 is at the same downward inclination as the guide rail 28*a* when the main unit 23 is completely inserted into the cabinet 21. Then, as the cabinet 21 is fastened to the base plate 24 by the bolts, and front panel 22 is mounted onto the front side of the cabinet 21, the installation of the air conditioner is completed.

Although cabinet 21 is installed in the horizontal plane, the base plate 24 is nonetheless at a downward inclination with respect to the outside of the building. Accordingly, the condensate droplets generated at indoor heat-exchanger 26*a* smoothly gravitate along inclined base plate 24 to the outside through drain hole 30. Moreover, although the cabinet 21 and the main unit 23 are separately installed according to this embodiment, the air conditioner also may be installed in a completely assembled form, since there is no need to adjust the predetermined installation angle of the air conditioner during the installation.

As described above, according to the present invention, the main unit 23 is mounted at a predetermined downward inclination by the inclination section (or "skid") 28 formed on the bottom of the cabinet 21. Accordingly, the cabinet 21 can be installed in a parallel relation with respect to the horizontal plane without lessening the draining efficiency for the condensate droplets. As a result, the installation of the air conditioner becomes easier, while the possibility of interference between the cabinet 21 and the wall 1 is reduced, so that the cabinet 21 or the wall 1 is prevented from possible deformation or fracture. Further, since the air conditioner can be installed in completely assembled form without needing to separate the cabinet 21 from the main unit 23, the installation steps are reduced and made cheaper.

The foregoing description of preferred embodiments has been presented for purposes of illustration and description. It is not intended to be exhaustive or to limit the invention to the precise form described. It will be obvious to those skilled in this art that many modifications and variations are possible in light of the above teaching. The embodiments were chosen in order to explain most clearly the principles of the invention and its practical application, thereby to enable others in the art to utilize most effectively the invention in various embodiments and with various modifications as are suited to the particular use contemplated.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. A window-type air conditioner apparatus, comprising:

a main unit having a base plate on which components of the air conditioner apparatus are mounted;

a cabinet comprising a component separate from said main unit and adapted for receiving the main unit; and a skid mounted on an interior surface of a bottom side of the cabinet for guiding a lower outer surface of a bottom side of the main unit as said main unit is received by the cabinet, said skid being adapted for maintaining a predetermined downward inclination angle of the main unit in the cabinet to permit condensation to drip outward from a building in which the air conditioner is mounted.

2. The apparatus of claim 1, wherein the skid comprises at least two guide rails formed on the bottom side of the cabinet at said predetermined downward inclination angle, said guide rails being adapted for supporting a lower side of the base plate at said predetermined downward inclination angle.

3. The apparatus of claim 2, wherein the downward inclination angle ranges from 2° to 5.

4. A method for facilitating installation of a window-type air conditioner unit into an aperture in a wall of a building, said method comprising the steps of:

(a) providing a main unit of the window-type air-conditioner unit with a base plate on which components of the window-type air-conditioner unit are mounted;

(b) providing a cabinet adapted for receiving the main unit;

(c) attaching a skid to an interior of a bottom side of the cabinet, said skid being adapted for maintaining a predetermined downward inclination angle of the main unit when the main unit is disposed in the cabinet to permit condensation to drip outward from the building in which the window-type air conditioner unit is mounted; and (d) sliding the main unit into the cabinet by using the skid to guide the main unit as the main unit is slid into the cabinet.

5. The method of claim 4, wherein the skid comprises at least two guide rails formed on the interior of the bottom side of the cabinet at said predetermined downward inclination angle, said guide rails being adapted for supporting a lower side of the base plate at said predetermined downward inclination angle.

6. The method of claim 4, wherein the downward inclination angle ranges from 2° to 5.

7. A skid for facilitating installation of a window-type air-conditioner into an aperture of a building, said window-type air conditioner having a main unit and a cabinet, the main unit being adapted to slide into the cabinet, said skid being mounted on an interior surface of a bottom side of the cabinet for guiding a bottom exterior surface of the main unit as said main unit is received by the cabinet, said skid being further adapted for maintaining a predetermined downward inclination angle of the main unit in the cabinet so as to permit condensation to drip outward from the building in which the window-type air conditioner is installed.

8. The skid of claim 7, wherein said skid comprises at least two guide rails formed on an interior of a bottom side of the cabinet at said predetermined downward inclination angle, said guide rails being adapted for supporting a lower side of a base plate in the main unit.

9. The skid of claim 8, wherein the downward inclination angle ranges from 2° to 5°.

10. The apparatus of claim 1, wherein said skid comprises at least one guiding element having an upper surface and a lower surface, said upper surface being angularly oriented relative to said lower surface by an angle equal to said predetermined downward inclination angle.

11. The apparatus of claim 1, wherein said skid comprises at least one guide rail formed on the bottom side of the cabinet, and wherein at least one rail groove is formed on the lower outer surface of the bottom side of the main unit for receiving said at least one guide rail.

12. The method of claim 4, further comprising the step, between steps (c) and (d), of mounting the cabinet in an aperture in the wall of the building.

13. The method of claim 4, further comprising step (e) of mounting the window-type air conditioner unit, including the main unit and the cabinet assembled together, in an aperture in the wall of the building.

14. The method of claim 4, wherein said skid comprises at least one guiding element having an upper surface and a lower surface, said upper surface being angularly oriented relative to said lower surface by an angle equal to said predetermined downward inclination angle.

15. The method of claim 4, wherein said skid comprises at least one guiding element, and at least one rail groove is formed on a bottom of the main unit for receiving said at least one guiding element.

16. The skid of claim 7, wherein said skid comprises at least one guiding element having an upper surface and a lower surface, said upper surface being angularly oriented relative to said lower surface by an angle equal to said predetermined downward inclination angle.

17. The skid of claim 7, wherein said skid comprises at least one guide rail formed on the bottom side of the cabinet, and wherein at least one rail groove is formed on the bottom exterior surface of the main unit for receiving said at least one guide rail.

* * * * *